US006603458B1

(12) United States Patent
Fischer et al.

(10) Patent No.: US 6,603,458 B1
(45) Date of Patent: Aug. 5, 2003

(54) ELECTROMAGNETIC DISPLAY DEVICE

(75) Inventors: Helmut Fischer, München (DE); Wolfgang Kögler, München (DE); Rudolf Pongratz, München (DE)

(73) Assignee: Annex Anzeignsysteme GmbH, Sulzbach/Main (DE)

( * ) Notice: Subject to any disclaimer, the term of this patent is extended or adjusted under 35 U.S.C. 154(b) by 0 days.

(21) Appl. No.: 09/856,444

(22) PCT Filed: Apr. 9, 1999

(86) PCT No.: PCT/DE99/01102

§ 371 (c)(1),
(2), (4) Date: May 22, 2001

(87) PCT Pub. No.: WO00/62274

PCT Pub. Date: Oct. 19, 2000

(51) Int. Cl.[7] ..... G09G 3/34; G09F 9/00

(52) U.S. Cl. ..... 345/111; 345/903; 40/449; 340/815.62

(58) Field of Search ..... 345/111, 108–109, 345/55, 903; 40/449, 452; 340/815.62, 815.64

(56) References Cited

U.S. PATENT DOCUMENTS 3,469,258 A * 9/1969 Winrow ..... 345/111
4,139,841 A * 2/1979 Roberts ..... 340/373
5,771,616 A * 6/1998 Tijanic ..... 40/449

FOREIGN PATENT DOCUMENTS

DE 3501912 A * 7/1986
EP 0327250 A2 * 8/1989
EP 0401980 B1 * 12/1990
EP 0463725 B1 * 1/1992

* cited by examiner

*Primary Examiner*—Lun-Yi Lao
(74) *Attorney, Agent, or Firm*—Edwin D. Schindler

(57) ABSTRACT

An electromagnetic display apparatus includes a panel having substantially square pixel, which are divided into two parts. Each pixel is provided with a rotatably-mounted, bistable tilting flap, which is asymmetrical in relation to its rotational axis. The tilting flap covers one of the two portions of the panel surface in the pixel zone when the flap lies in each of its two stable positions. The side of the tilting flap facing the front side of the panel and the portion of the panel in the pixel zone, which is covered by the tilting flap and the other portion of the panel in the pixel zone has a second color. A permanent magnet is fitted to the tilting flap in close proximity to the rotational axis. The tilting flap is displaced from a first position into a second position by an electromagnet, which is located on the reverse side of the panel and is allocated to the pixels and which has a coil body and core. The apparatus is connected to a base plate, which faces the reverse side of the panel, and has at least one opening in one section of each pixel. A pin, which is located on the base plate, is allocated to each opening and is directed toward the opening. The pin contains a recess on the side facing the panel, in which a light-emitting diode is inserted.

17 Claims, 2 Drawing Sheets

Figur 1
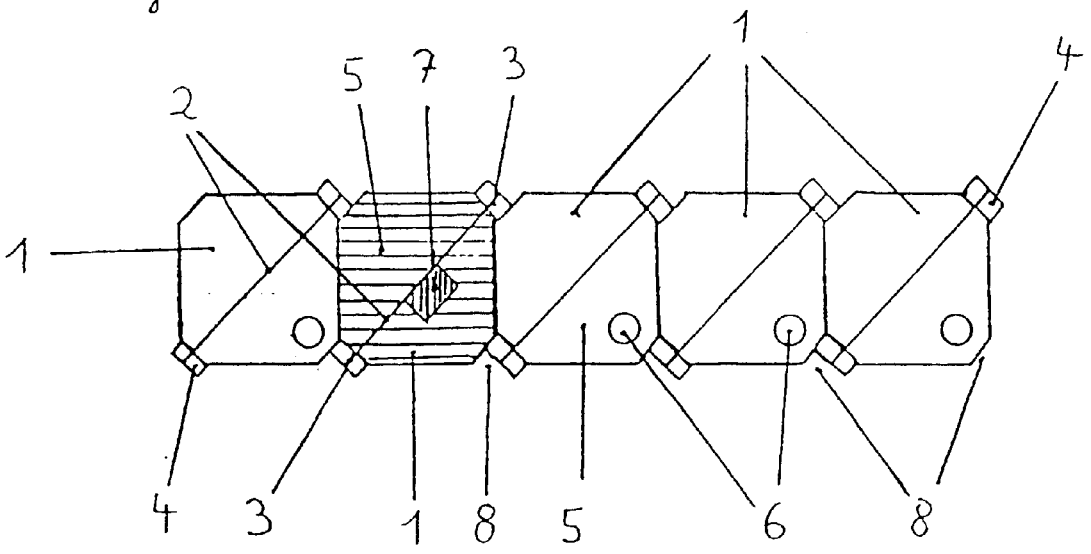

Figur 2
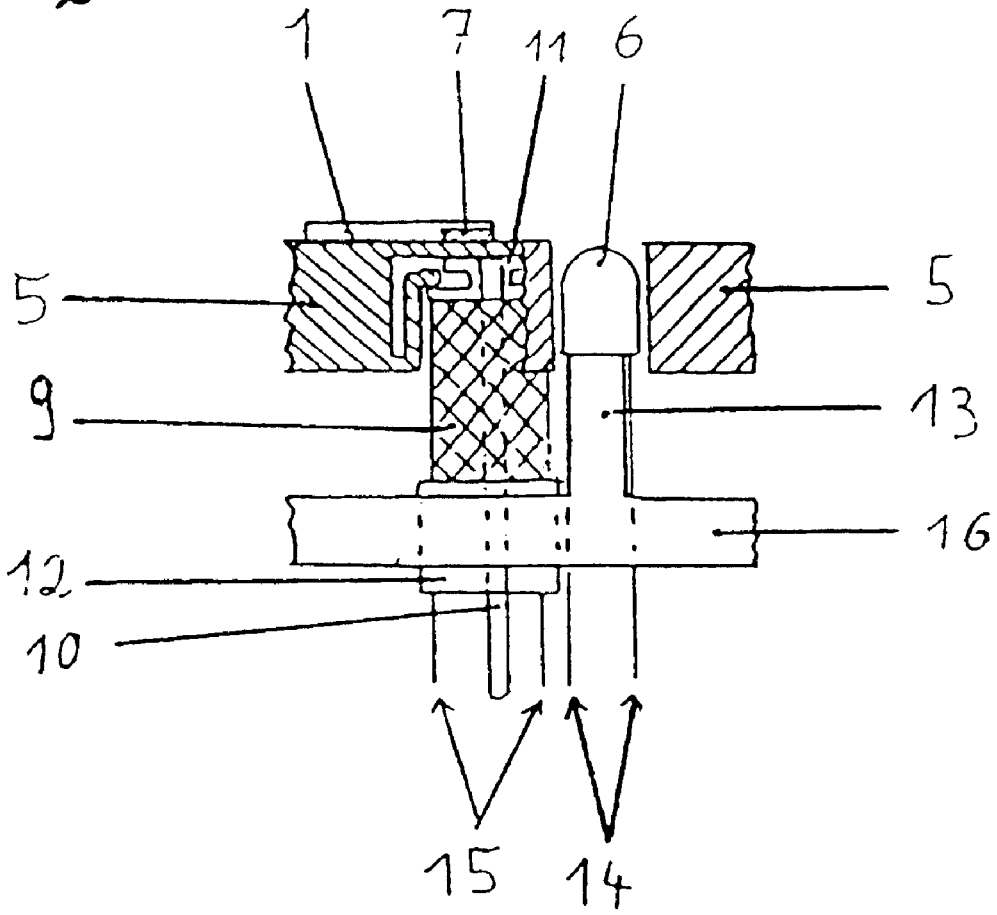

ELECTROMAGNETIC DISPLAY DEVICE

This application is a 371 of PCT/DE99/01102 filed on Apr. 9, 1999, now WO 00/62274.

BACKGROUND OF THE INVENTION

1. Technical Field of the Invention

The invention relates to an electromagnetic display device, comprising a panel which consists of a number of substantially square pixels which are divided into two parts. Each pixel is provided with a rotatably mounted bistable tilting flap, which is asymmetrical in relation to its rotational axis. Said tilting flap covers one of the two portions of the panel surface in the pixel zone when the flap lies in each of its two stable positions. The side of the tilting flap facing the front side of the panel and the portion of the panel in the pixel zone which is covered by the tilting flap in this position has a first colour and the other side of the tilting flap and the other portion of the panel in the pixel zone has a second colour. A permanent magnet is fitted to the tilting flap in close proximity to the rotational axis. The tilting flap is displaced from a first position into a second position by an electromagnet which is located on the reverse side of the panel and is allocated to the pixels, and which has a coil body, with coil head and coil base, and core.

2. Description of the Prior Art

Electromagnetic display devices of this kind are used for the construction of display boards, in which tie displayed information can be changed, that is to say exchanged or adapted, in a simple manner. To this end, the display board comprises a multiplicity of individual picture elements, the pixels, which are arranged in the form of a matrix and can be switched back and forth between two different states, such that they appear, for example, in a light or dark colour. These pixels may be used to compose any appropriate letters, numerals or other characters, a matrix comprising seven cells of five pixels each being sufficient for the display of most characters.

Patent specifications DE 35 01 912 C2 and DE 36 01 018 C2 disclose an electromagnetic display device of this generic type which consists of a matrix of square pixels arranged on a panel, each pixel being equipped with a bistable tilting flap which is rotatably mounted in two bearing brackets and is in the form of a right-angled triangle, the rotational axis being congruent with the hypotenuse of the triangle. In both of its stable positions, the tilting flap covers one half in each case of that portion of the panel associated with the square pixel, the respective visible portions of the panel and tilting flap being coloured uniformly, and differently for the two positions of the tilting flap, for example black and white. The changeover between the two display states of the pixel is carried out by means of an electromagnet arranged below the pixel, which comprises a coil body and pin-shaped core, and the tilting flap equipped with a permanent magnet tilting back and forth between the two positions on the application of a corresponding voltage. This construction of the individual pixel allows almost complete utilization of the display surface, with virtually no interspaces, by the picture elements, which are only somewhat impaired by the recesses required in the vicinity of the bearing brackets. The result of this good area filling is good legibility of the letters, numerals and other characters represented by means of the display device, provided that they are sufficiently illuminated by daylight or artificial light. At poorly illuminated places or in darkness, on the other hand, this type of display can only be used in conjunction with an additional light source, which lights up its front surface.

Patent specification EP 0 401 980 B1 describes a display device that can also be read in darkness and whose individual pixels each consists of a circular disc, which has a radially extending slit and is rotatably mounted on the rotational axis extending perpendicular to the slit on the diameter of the circular disc. The circular disc can be rotated through an angle of about 180° between two stops by means of a permanent magnet located next to said circular disc on the rotational axis and an electromagnet arranged behind said permanent magnet. As a consequence, in one position the light-coloured front side of the circular disc is directed towards the observer and the end of a fibre-optic light guide in the slit becomes visible, whereas in the other position the dark side of the circular disc faces forwards and covers the fibre-optic light guide. Patent specification EP 0 463 725 B1 discloses a similarly constructed display device, in which the circular disc is only rotated through 90°, so that, in one position, the light-coloured front side and, in the other position, the dark edge of the circular disc, faces forwards. The light sources used to illuminate the pixel, in particular light-emitting diodes, are, in the first position of the pixel, visible through a circular opening in the circular disc and, with the changeover of the pixel, are disconnected by means of a reed contact.

The last-mentioned display devices possess, by virtue of the light-coloured sources integrated into the pixel, the advantage that they can also be operated and read in darkness. However, this is countered by the disadvantage that the portions of the pixel used for the display are circular and, because of the electromagnetic display device arranged next to the circular disc, are spaced from one another. This results in a comparatively small area density and therefore an impairment of the legibility of these display devices. In addition, in the case of circular pixels, the discs, at least in one of their switching states, are not disposed parallel to the display plane, so that the pixel has a different appearance when observed from different directions. A particular disadvantage of pixels formed as circular discs can be seen in the fact that the light source is usually arranged behind the disc, which leads to partial attenuation of the emitted light and significantly impairs the legibility of the corresponding display device from the side.

SUMMARY OF THE INVENTION

On this basis, it is the object of the present invention to provide an electromagnetic display device that ensures good legibility of the information presented both under light conditions and in darkness.

This object is achieved according to the present invention in that the display device has a base plate, the coil base of the electromagnet is inserted in the base plate, the coil head is attached to the panel, each pixel is provided with an opening in the panel and a pin, which is located on said base plate and is directed towards said opening, and on which a light-emitting diode is mounted, is allocated to each pixel.

The present invention is based on the idea of forming the electromagnetic display device with pixels that are readily legible in daylight and are switchable back and forth by means of bistable tilting flaps between two colours, for example a light colour such as white or yellow, which may be embodied as a reflective film, and a dark colour such as black, and by providing each pixel with at least one light-emitting diode (LED), which is preferably arranged in the light-coloured region and promotes the legibility of the display device in failing light and ensures good legibility even in darkness. To this end the electromagnetic display device is to be provided with square pixels, which are switchable between two colours, preferably a light and a dark colour, by means of bistable tilting flaps, which assume one of two possible positions on the pixel depending on the switching state. For their movement, the tilting flaps are fitted, in close proximity to their rotational axis, with a permanent magnet which, depending on the position of the tilting flap, is arranged with either its north or south pole in the direction of the electromagnet, which is arranged on the reverse side of the panel, is allocated to the respective pixel and comprises a coil body and a pin-shaped core, which is introduced into said coil body and composed of electromagnetically soft or retentive material. The use of a retentive material here has the advantage that, for triggering a switching operation, magnetic reversal of the core is sufficient, the current pulse on the coil can therefore be considerably shorter than the actual changeover operation of the tilting flap. At the same time, the magnetization of the retentive core ensures reliable holding of the tilting flap in the position, once this has been set. To ensure the recognizability of the display device according to the invention even in darkness, each pixel is provided on its reverse side with a light-emitting diode, which shines through an opening introduced into the light-coloured region of the pixel. In this application, the light-emitting diode can be operated with such a low current that its lifetime is virtually unlimited. A base plate arranged behind the panel serves for fixing the electromagnet and light-emitting diode in defined positions and distances corresponding to the grid dimensions of the pixels. To this end, the coil bases are inserted into the base plate, which is equipped with pins directed towards the openings in the pixels, said pins receiving the light-emitting diodes and, in this manner, ensuring a uniform distance from the openings in the individual pixels, which results in good legibility of the display device in darkness.

A particularly simple and therefore preferred rotational mounting of the tilting flaps is obtained by integral moulding of corresponding bearing brackets on the panel, which receives bearing pins disposed at the ends of the rotational axis of the tilting flap.

The tilting flap is, in its two stable positions, required to cover in each case one half of the square pixel. This can be achieved, for example, by means of a tilting flap designed in the form of a rectangle, in which the rotational axis passes through one of the long sides of the rectangle. A more favourable weight distribution with respect to the rotational axis, and therefore a lower moment of inertia, however, is obtained by designing said tilting flap in the form of a right-angled isosceles triangle, in which the rotational axis is congruous with the hypotenuse of the triangle. Greater switching speeds and the possibility of 90° rotation of the display without changing its physical properties are the advantages of this design of the tilting flaps. For a good area filling of the display board, the corners adjacent to the rotational axis, and possibly other corners, may also have to be provided with recesses for receiving the bearing brackets.

The permanent magnet necessary for moving the tilting flaps can, in the simplest case, be bonded onto the tilting flap in the vicinity of the tilting axis. In a further development of the invention, the permanent magnet is inserted into a recess introduced into the tilting flap, which is subsequently closed, for example glued up or welded. In this manner, the permanent magnet is reliably protected against harmful environmental effects and neither runs the risk of corroding, falling off or moving.

In an advantageous embodiment of the invention, attachment of the electromagnet to the panel and base plate is carried out by means of detachable snap connections which can be formed in recesses of the panel and base plate with utilization of the elasticity of the material, and in which a coil head and coil base can be engaged. This results in an easier-to-repair, modular construction of the display device according to the invention, in which electromagnets and light-emitting diodes, but in particular the panel with the tilting flaps, can be easily exchanged.

In a preferred embodiment, the base plate of the display device is formed such that the coil base of the electromagnet can be easily inserted and engaged in the base plate from the side in a radial direction, a bead on the base plate engaging in a groove on the coil base so as to fix the electromagnet against axial displacement. An advantage of this design of the display device lies in the facilitation of its assembly by means of automatic means, which can simply slide in the electromagnet in a radial direction, while the light-emitting diode must be inserted axially.

Since the light-emitting diodes of the tilting flap are exposed in one position and covered in the other, the display device according to the invention can readily be operated with permanently lit light-emitting diodes. To reduce power consumption and operating costs, however, it is recommended that the light-emitting diodes be connected so that they are switched on and off with the movements of the associated tilting flap, that is to say only illuminate when they are exposed by the associated tilting flap.

For good legibility of the display device in darkness, a larger angle of spread for the light emitted from the individual pixels is desirable. To this end the height of the pin, disposed on the base plate, for the light-emitting diodes of the individual pixels is chosen such that the upper end of the light-emitting diode terminates flush with the front side of the panel, that is to say is in the same plane with the panel front side, and consequently the attenuation of the light emitted by the light-emitting diode by the side wall of the opening is kept to a minimum, without impairment of the movement of the tilting flaps. This flush method of installation of the light-emitting diodes results in a large reading angle, which permits rapid apprehension of the picture element by the eye. In an advantageous further development of the invention, the individual pixels are equipped with a transparent front pane, which is illuminated from its reverse side by the light-emitting diode allocated to the pixel and diffuses the transmitted light as a diffuser. With this design of the pixels, it is expedient for good illumination of the transparent covering to design the opening in the panel such that the light of the light-emitting diode can pass through as large as possible a part of that portion of the pixel that is not covered by the tilting flap. In a further development of the invention, both portions of each pixel are equipped with, in each case, one or more light-emitting diodes, different coloured light-emitting diodes being expediently used on the two pixel portions, the colour of which is matched to the respective coloration of those portions of the pixel to which they are allocated. In this manner, display devices can be provided which, even in darkness, can display coloured characters against a differently coloured background and are therefore ideally suited for information or advertising purposes.

In an expedient embodiment of the invention, the individual pixels on the panel can be arranged in the form of a matrix, which, for example, may contain seven lines with five pixels each, that is to say a total of 35 pixels, it being possible to display numerals, letters and other characters. From a multiplicity of such display devices, display boards for the representation of a plurality of characters can be constructed, whose size can be flexibly matched to need, depending on the particular purpose of the panel. It is also conceivable, instead of the matrix-like arrangement of pixels on the panel to choose a strip-shaped arrangement, the strips being arranged in columns or strips also forming a matrix for the display of numerals, letters and characters. Good space utilization of the area available on the display board, and good legibility of the information represented there requires, as far as possible. complete utilization of the pixel area for the display and the least possible interspace between the areas used for the display, not only the immediately adjacent pixels on a panel but also pixels arranged side-by-side on adjacent panels. Here, the accommodation of the bearing brackets becomes a problem since, on one hand they should be arranged as far as possible towards the outside at the pixel edge in order not to impair the useful display area of the pixel, but on the other hand this undesirably increases the interspace between adjacent pixel rows. As an expedient compromise solution to this problem, the invention provides for arranging the bearing brackets of a tilting flap so far towards the outside that they partly project over the square pixel surface and, together with the bearing bracket of the respective adjacent pixel, are arranged in the region of recesses introduced at the corners of the square pixel. To allow the continuation of this design even over adjacent panels, the invention recommends that the edges of each panel be provided with recesses in the region of the bearing brackets, which recesses can receive the projecting bearing brackets of the adjacent panel. In this manner, a defined arrangement of the pixels of adjacent panels with very small interspaces is obtained, which is to the benefit of the space utilization on the display board and the legibility of the information displayed.

The field distribution of the magnetic field generated by the electromagnet can be influenced by the precise shape of the pin-shaped coil core. For rapid and reliable tilting over of the tilting flaps, it is desirable to have a high field intensity, and thus a focusing of the field lines in the region of the permanent magnet above the coil head. To this end, the invention recommends extending the coil core in an axial direction through the coil base, which intensifies the focusing of the lines of force at the coil head and at the same time reduces undesirable leakage fields in the region of neighbouring coils. The lower ends of the coil cores can be inserted through bores in the circuit board, to which the electrical connections of light-emitting diodes and electromagnets are soldered for the power supply. By this means, a guide, which facilitates the assembly of the circuit board, and increased mechanical stability of the entire arrangement are obtained.

BRIEF DESCRIPTION OF THE DRAWING FIGURES

Further details, features and advantages of the invention according to the invention can be obtained from the following descriptive part, in which a typical embodiment of the invention is described in greater detail by means of two drawings, wherein FIG. 1 shows a plan view of a display device according to the invention, consisting of a strip of pixels, and FIG. 2 shows a side view of a pixel of a display device according to the invention, which is partly drawn in section.

DETAILED DESCRIPTION OF THE DRAWING FIGURES AND PREFERRED EMBODIMENTS

FIG. 1 shows a plan view of an electromagnetic display device according to the invention, which consists of 5 pixels arranged on a strip. Each of the pixels possesses an essentially square form with recesses at the four corners and is divided into two parts along its diagonal, each part being covered by a tilting flap (1). The tilting flaps (1) possess the form of right-angled isosceles triangles with recesses at the corners, the hypotenuse (2) of the triangles being congruent with the rotational axis of the tilting flap. At both ends of the rotational axis are arranged bearing pins (3), with which the tilting flap is rotatably mounted in bearing brackets (4). At the bottom right-hand side of each pixel, the panel (5) is provided with an opening, through which a light-emitting diode (6) can be seen. At the second pixel from the left, the tilting flap (1) is represented in a position in which it covers the light-emitting diode (6). The upward facing side of the tilting flap (1) and the visible part of that portion of the panel (5) associated with the pixel are coloured a dark colour, shown here as hatch marks. The other four pixels shown in the drawing, on the other hand, are in the other possible switching state, in which the tilting flap assumes a position in which the pixel appears in a light colour and the light-emitting diode (6) can be seen. The switchover between the two positions is carried out by means of an electromagnet arranged below each pixel, which acts on the permanent magnet (7) fastened to the tilting flap. The panel (5) is provided on its sides with recesses (8), which are contiguous with the bearing brackets (4) and permit a plurality of lines of the electromagnetic display device according to the invention to be arranged adjacently in a defined position without interspace between the pixels, and thus form, for example, a matrix of seven such lines, with which letters, numerals and other characters can be easily represented.

FIG. 2 shows a pixel of the display device according to the invention in side view, drawn partly in sectional view. A section through the panel (5), shown extending partly through the centre plane of the pixel and partly through the plane of the light-emitting diode, with the tilting flap and the opening with the light-emitting diode (6) can be seen, the upper end of the light-emitting diode (6) being in a plane with the front side of the panel (5). Below the pixel centre, an electromagnet is arranged, which consists of a coil body (9) with coil head (11) arranged above and coil base (12) arranged below, and a pin-shaped core (10) consisting of retentive material. Coil head (11) and coil base (12) engage in corresponding recesses in panel (5) and base plate (16), where they engage in detachable snap connections. To facilitate the exchange of the panel (5), only two of the pixels, for example the second and fourth, are here equipped with snap connections for the spool head (11). On the base plate (16), there is arranged a pin (13) to be directed to the opening for the light-emitting diode (6) in the panel (5), which pin has on its upper end face a recess in which a light-emitting diode (6) is held in a well defined position. Axial grooves on its surface extending in an axial direction serve to receive the electrical connections (14) of the light emitting diode (6). For power supply to the pixel, they and the electrical connections (15) of the electromagnet are firmly soldered to a circuit board, which additionally receives the lower end of the pin-shaped core (10) in a bore, whereby the position of the pixel is reliably fixed on the circuit board.

As a result, an electromagnetic display device is obtained, which is characterized by high area coverage and is recognisable and legible equally well by day and night.

What is claimed is:

1. An electromagnetic display apparatus, comprising:

a base plate;

a panel having substantially square pixels divided into two parts with each said substantially square pixel having a rotatably mounted bistable tilting flap asymmetrically arranged relative to its rotational axis, with each said pixel having an opening in said panel, said tilting flap covering a first part of said two parts of said panel when said tilting flap lies in each of its two stable positions, with a first side of said tilting flap facing a front side of said panel and said first part of said panel covering one of said two parts of said panel being covered by said tilting flap in this position, said first side of said tilting flap having a first color and said second side of said tilting flap and a second part of said two parts of said panel having a second color;

a pin for each respective said pixel is located on said base plate and facing in a direction of said opening in said panel;

a light-emitting diode mounted on said pin;

an electromagnet located on a reverse side of said panel and allocated to said pixels, said electromagnet having a coil body with a coil head, a coil base and a core, with said coil head being fastened onto said panel and said coil base being inserted into said base plate; and, a permanent magnet being fitted to said tilting flap in close proximity to said rotational axis of said tilting flap, said tilting flap being displaced from a first position into a second position by said electromagnet.

2. The electromagnetic display apparatus according to claim 1, wherein one of said tilting flaps is located on each end of the rotational axis thereof and has bearing pins, said bearing pins being mounted in bearing brackets integrally molded on said panel.

3. The electromagnetic display apparatus according to claim 1, wherein said tilting flaps are substantially rectangular.

4. The electromagnetic display apparatus according to claim 1, wherein said tilting flaps are substantially triangular.

5. The electromagnetic display apparatus according to claim 4, wherein said tilting flaps are shaped as right triangles and said rotational axis is congruous with a hypotenuse of said right triangle.

6. The electromagnetic display apparatus according to claim 1, wherein said permanent magnet is bonded onto said tilting flap.

7. The electromagnetic display apparatus according to claim 1, wherein said tilting flap includes a pocket with said permanent magnet being inserted into said pocket.

8. The electromagnetic display apparatus according to claim 1, wherein said base plate and said panel have recesses, in which said coil head and said coil base of said electromagnet are detachably fastened with snap connections.

9. The electromagnetic display apparatus according to claim 8, wherein said coil body with said coil base is insertable in a radial direction into the recess of said base plate.

10. The electromagnetic display apparatus according to claim 1, wherein said a light-emitting diode is a permanently illuminated light-emitting diode.

11. The electromagnetic display apparatus according to claim 1, wherein said light-emitting diode of each of said pixels is switchable "on" and "off" via movement of a respective said tilting flap.

12. The electromagnetic display apparatus according to claim 1, wherein an upper end of said light-emitting diode terminates flush with said front side of said panel.

13. The electromagnetic display apparatus according to claim 1, further comprising a transparent covering for said openings in said panel.

14. The electromagnetic display apparatus according to claim 1, wherein each respective said light-emitting diode is allocated to said two parts of each said pixel.

15. The electromagnetic display apparatus according to claim 1, wherein said pixels are arranged on said panel as a matrix.

16. The electromagnetic display apparatus according to claim 1, wherein said pixels are arranged on said panel in strips.

17. The electromagnetic display apparatus according to claim 1, wherein said coil core of said electromagnet is extended axially through said coil base.

* * * * *